US007712346B2

(12) United States Patent
Kanouse

(10) Patent No.: US 7,712,346 B2
(45) Date of Patent: May 11, 2010

(54) TOOLING DIE SLIDE DRIVER

(75) Inventor: Daniel B. Kanouse, Morley, MI (US)

(73) Assignee: Trusted Tooling, LLC, Morley, MI (US)

( * ) Notice: Subject to any disclaimer, the term of this patent is extended or adjusted under 35 U.S.C. 154(b) by 817 days.

(21) Appl. No.: 11/545,206

(22) Filed: Oct. 10, 2006

(65) Prior Publication Data

US 2007/0240482 A1 Oct. 18, 2007

Related U.S. Application Data

(60) Provisional application No. 60/791,985, filed on Apr. 14, 2006.

(51) Int. Cl.
*B21D 5/04* (2006.01)
*B26D 5/16* (2006.01)

(52) U.S. Cl. ..... 72/452.9; 72/315; 83/588; 83/635; 29/798; 29/818

(58) Field of Classification Search ..... 72/313, 72/315, 452.7, 452.9; 83/588, 635; 29/798, 29/818

See application file for complete search history.

(56) References Cited

U.S. PATENT DOCUMENTS 3,777,529 A 12/1973 Kaufmann
4,002,093 A * 1/1977 Heisler ..... 83/405
4,799,300 A 1/1989 Phillips
5,231,907 A * 8/1993 Matsuoka ..... 83/588
5,904,064 A * 5/1999 Higuchi ..... 72/452.9
6,021,562 A 2/2000 Boster
6,158,122 A 12/2000 Skudutis
6,164,115 A * 12/2000 Higuchi et al. ..... 72/452.9
6,418,611 B1 7/2002 Weber
6,578,402 B2 6/2003 Weil
6,931,901 B2 8/2005 Ghiran
6,952,941 B2 10/2005 Friedman
7,191,635 B2 * 3/2007 Chun et al. ..... 72/452.9
7,523,634 B2 * 4/2009 Krozek ..... 72/452.9

* cited by examiner

*Primary Examiner*—David B Jones
(74) *Attorney, Agent, or Firm*—Carlson, Gaskey & Olds PC

(57) ABSTRACT

A slide driver assembly for use in a multi-station or a single-station progressive tooling die includes die sections that are operative to move between an open position and a closed position to perform a first operation on a work piece located between the die sections. A slide driver performs a second operation, such as a trimming operation, on the work piece as the die sections move between the open position and the closed position.

16 Claims, 2 Drawing Sheets

TOOLING DIE SLIDE DRIVER

RELATED APPLICATIONS

This application claims priority to U.S. Provisional Patent Application No. 60,791,985, which was filed Apr. 14, 2006.

BACKGROUND OF THE INVENTION

This invention relates to tooling dies and, more particularly, to progressive dies. Progressive die tooling is widely known and used in forming parts. Typically, progressive die tooling includes an upper die and a lower die that together define a single station or a series of stations for performing various operations to form a part. For example, one station might punch a hole through a desired location of the part, stamp a portion of the part into a desired shape, or insert a fastener into the part.

It is often desirable to trim the part to remove, for example, a rough edge produced at one of the stations. Typically, the progressive die tooling includes one or more trimming tools that are pneumatically operated to trim the part. The trimming occurs when the die is open or closed to avoid interfering with the movement of the die and the operations of the stations. For example, one or more trimming tools might be actuated to trim various portions of the part.

Disadvantageously, using trimming tools often requires that the die pauses for a time in the open or closed position while the trimming tools trim the part. The pause increases the cycle time, which adds to the expense of producing the part. Additionally, if the portions to be trimmed are close together, some of the trimming tools may have to wait for earlier trimming tools to finish in order to avoid interfering with each other, which adds even more pause time. Furthermore, the trimming tools also typically occupy a significant amount of space in or along the die, which adds to the cost of the die. Thus, there is a need for a more compact die tooling that is capable of trimming a part without delaying the opening and closing of the die. This invention addresses those needs while avoiding the shortcomings and drawbacks of the prior art.

SUMMARY OF THE INVENTION

A slide driver assembly for use in a multi-station or a single-station progressive tooling die includes die sections that are operative to move between an open position and a closed position and back to the open position to perform a first operation on a work piece located between the die sections. A slide driver associated with the die sections performs a second operation, such as a trimming operation, on the work piece as the die sections move between the open position and the closed position and back to the open position.

In one example, the slide driver includes spaced apart guide members. One of the guide members includes a cam track and the other guide member includes a corresponding cam track for guiding movement of a cam member. The cam member is coupled with a tool, such as a blade, for performing the second operation. As the die sections move from the open position to the closed position and back to the open position, the cam member moves along the cam tracks. The cam tracks are shaped such that the cam member moves away from the work piece as the die sections open and first moves toward the work piece and then moves away from the work piece as the die sections close. Thus, over a single cycle, the die sections perform the first operation, such as a stamping operation, and the slide driver performs the second operation, such as trimming, without need to pause for the trimming.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
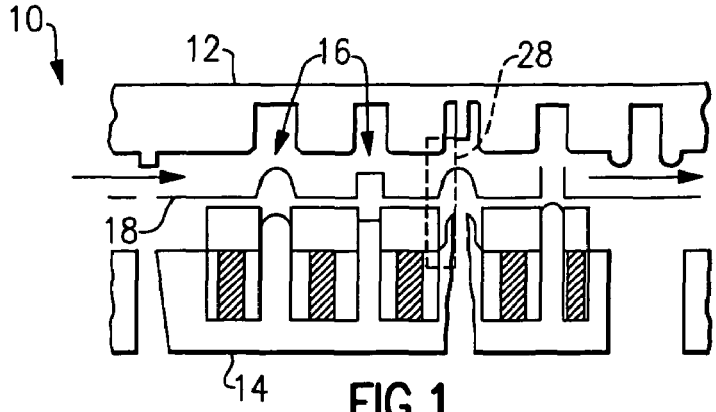
FIG. 1 illustrates an example multiple-station progressive tooling die in an open position.
Figure 2:
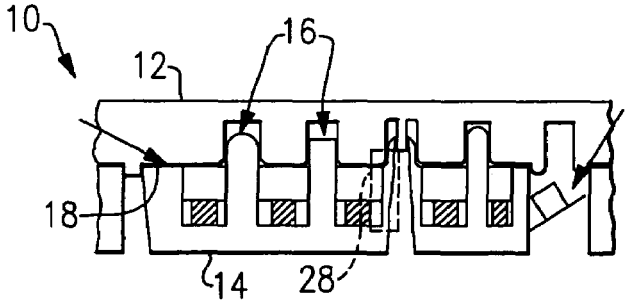
FIG. 2 illustrates the multiple-station progressive tooling die of FIG. 1 in a closed position.

FIGS. 1 and 2 illustrate selected portions of an example progressive tooling die 10 in, respectively, an open and a closed position. In this example, the progressive tooling die 10 includes an upper die 12 and a lower die 14 that define a series of stations 16 for forming a part. In the illustrated example, the part is formed from a continuous feed of material 18, however, alternatively the parts may also be formed from individual material blanks fed into the progressive tooling die 10. As the material 18 or blank moves from one station 16 to another, each station 16 performs an operation, such as stamping, hole punching, or other known operation, to form the part.

In this example, the progressive tooling die 10 includes a slide driver 28 shown schematically with one of the stations 16. Although only one slide driver 28 is shown, multiple slide drivers 28 may be used with multiple stations 16 as desired. In the disclosed example, the closing an opening of the dies 12 and 14 actuates the slide driver 28 to perform an additional operation on the material 18 or blank at the particular station 16. As will be described below, the slide driver 28 thereby provides the benefit of performing at least two operations at a single station 16 without the tooling for each of the operations interfering with each other.

Figure 3:
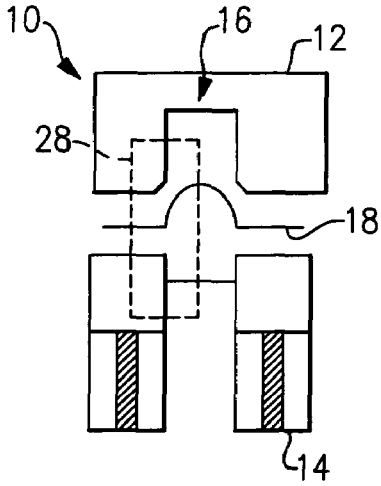
FIG. 3 illustrates an example single-station progressive tooling die.

While FIGS. 1 and 2 show the tooling die 10 with multiple stations 16 for a continuous forming operation, the slide driver 28 may also be used in a single-station tooling die 10 as shown schematically in FIG. 3 for example. Similar to the multiple station tooling die (FIGS. 1 and 2), the slide driver 28 in the single-station tooling die 10 also provides the benefit of performing at least two operations at a single station 16 without the tooling for each of the operations interfering with each other.

Figure 4:
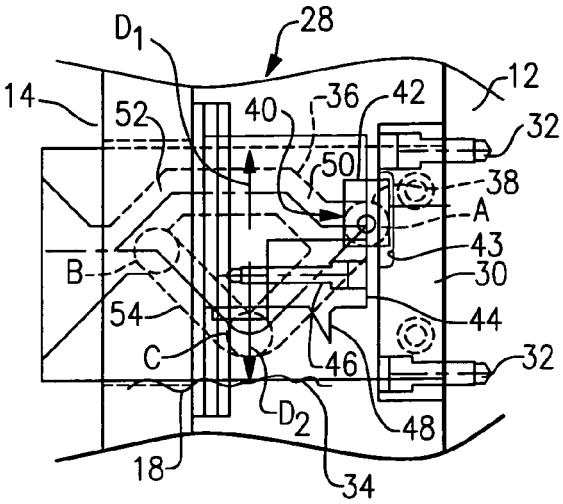
FIG. 4 illustrates a side view of an example slide driver for use in a progressive tooling die.
Figure 6:
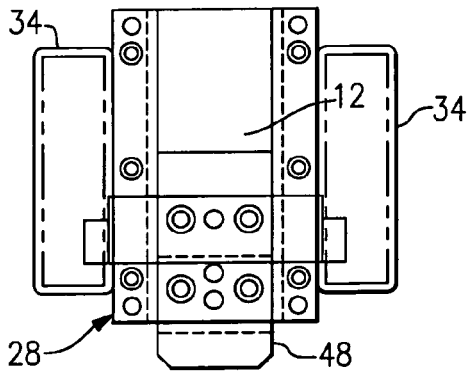
FIG. 6 illustrates a top view of the slide driver.
Figure 5:
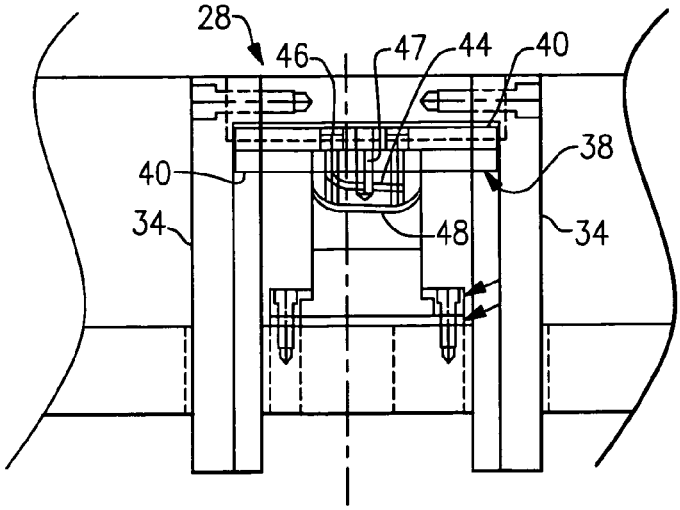
FIG. 5 illustrates a different side view of the slide driver.

FIGS. 4-6 illustrate selected portions of one example slide driver 28 for performing a trimming operation. In this example, the slide driver 28 includes a slide guide retainer 30 secured to the upper die 12 with fasteners 32. Slide guides 34 extend from the lower die 14. Each of the slide guides 34 includes a cam track 36. A cam follower 38 having a guide portion 40 (e.g., a roller) on each end extends between the cam tracks 36. The guide portions 40 are adapted to move, slide, or roll along the cam tracks 36. In the disclosed example, the cam follower 38 includes a guide ram 42 for moving the cam follower 38. The guide ram 42 is received partially within a guide groove 43 within the slide guide retainer 30. Alternatively, the guide groove 43 can be included within the upper die 12, thereby eliminating the need for the retainer 30.

In this example, a slide nose 44 is secured to the cam follower 38 with a fastener 46. A dowel pin 47 facilitates positioning of the slide nose 44 (i.e., a holder). The slide nose 44 is adapted to receive and secure a blade 48 in this example. Alternatively, the slide nose 44 is adapted to receive and secure another type of tool, such as a hole punch, stamping die, or other known tool.

In the disclosed example, the cam tracks 36 are designed to guide the cam follower 38 such that during one cycle of the dies 12 and 14 moving from open to close to open again, the blade 48 reciprocates in a trimming motion. In this example, the cam follower 38 is just to the left of position B when the dies 12 and 14 are open and is near position A when the dies 12 and 14 are fully closed. When the dies 12 and 14 begin to close from the open position, the cam follower 38 is guided into a V-shaped portion 54 of the cam tracks 36 at position B. Initially, the V-shaped portion 54 begins to extend the blade 48 in the direction $D_2$. In position C at the peak of the V-shaped portion 54, the blade has extended far enough to trim the material 18 in this example. As the dies 12 and 14 continue to close, the cam follower 38 continues to move along the other side of the V-shaped portion 54 such that it retracts along the $D_1$ direction on the way to position A at fully closed.

When the dies 12 and 14 begin to open from the closed position, the cam follower 38, and thus the blade 48, travels along the cam track 36 and encounters a first angled portion 50 of the cam tracks 36. The first angled portion 50 retracts the cam follower 38 and the blade 48 in a direction $D_1$ as the cam follower moves along the cam tracks 36, which in this example is away from the material 18 (shown schematically). As the cam follower 38 continues to move along the track 36, it encounters a second angled portion 52. The second angled portion 52 guides the cam follower 38 such that it begins to move in a direction $D_2$. Once the dies 12 and 14 are completely open, the cam follower 38 is just to the left of position B in FIG. 4. In this manner, the blade 48 moves away from the material 18 during opening of the dies 12 and 14 to provide a desired clearance around the material 18 for another operation.

Using the actuation of the dies 12 and 14 in cooperation with the cam tracks 36 to trim the material 18 provides several benefits. For one thing, the shape of the cam tracks 36 allows the blade 48 to extend and retract in a desirable manner to access the portion of the part that is to be trimmed, such as an undercut or side portion for example. Retraction of the blade 48 along the direction $D_1$ during opening of the dies 12 and 14 moves the blade 48 out of the way to provide a desired clearance around the material 18. Retraction of the blade 48 along the direction $D_1$ after the peak of the V-shaped portion 54 move the blade 48 out of the way such that another forming operation at the station 16 can be performed without interference from the blade 48 during the opening of the dies 12 and 14. Thus, two forming operations can be performed at a single station 16 within a multiple station tooling die 10 (FIGS. 1 and 2) or a single-station tooling die 10 (FIG. 3), while avoiding restriking that is known in some prior arrangements to lead to die wear or other problems.

Although the cam tracks 36 are shown with a certain design and shape in the disclosed examples, it is to be understood that alternate cam track 36 designs may be used to meet the particular needs, shapes, or sizes of the progressive tooling die 10 and the part. The slide driver 28 also provides the benefit of performing the operation during the opening and closing of the dies 12 and 14, thereby reducing or eliminating delay associated with conventional pneumatic trimming operations.

Although a preferred embodiment of this invention has been disclosed, a worker of ordinary skill in this art would recognize that certain modifications would come within the scope of this invention. For that reason, the following claims should be studied to determine the true scope and content of this invention.

I claim:

1. A slide driver assembly for use in a multi-station or a single-station progressive tooling die, comprising:

die sections that are operative to move between an open position and a closed position to perform a first operation on a work piece located between the die sections; and a mechanism that performs a second operation on the work piece as the die sections move between the open position and the closed position, the mechanism includes a cam track, a cam member associated with said cam track, and a tool coupled for movement with the cam member, wherein moving the die sections causes the cam member to move along the cam track to move the tool, and the cam track includes a first angled portion that first guides the tool toward the work piece and a second angled portion that then guides the tool away from the work piece as the die sections move from the open position toward the closed position.

2. The slide driver assembly recited in claim 1, wherein the cam track defines a 360° path of movement of the cam member.

3. The slide driver assembly recited in claim 1, wherein the cam member completes one revolution around the cam track in response to one cycle of the die sections moving from the open position to the closed position and back to the open position.

4. The slide driver assembly recited in claim 1, wherein the mechanism includes spaced apart guide members that extend from one of the die sections, one of the spaced apart guide members having the cam track and the other spaced apart guide member having a corresponding cam track.

5. The slide driver assembly recited in claim 4, wherein the mechanism includes the cam member extending between the spaced apart guide members and is at least partially within each of the cam tracks.

6. The slide driver assembly recited in claim 5, wherein the mechanism includes a retainer member secured to the other of the die sections, the retainer member moving between the spaced apart guide members and having a groove that at least partially receives the cam member.

7. The slide driver assembly recited in claim 6, wherein the cam tracks defines a 360° path of movement of the cam member.

8. The slide driver assembly recited in claim 1, wherein movement of the die sections between the open and the closed positions actuates the mechanism to perform the second operation.

9. A slide driver assembly for use in a multi-station or a single-station progressive tooling die, comprising:

die sections that are operative to move between an open position and a closed position to perform a first operation on a work piece located between the die sections; and a mechanism that performs a second operation on the work piece as the die sections move between the open position and the closed position, wherein the mechanism includes a cam track defining a 360° path of movement and having a first angled portion and a second angled portion, a cam member moveable along the cam track such that the first angled portion guides the cam member away from the work piece and a second angled portion guides the cam member toward the work piece, and a tool coupled for movement with the cam member, wherein moving the die sections causes the cam member to move along the cam track to move the tool.

10. The slide driver assembly recited in claim 9, wherein the cam member includes a dowel pin that extends there from, and a holder received on the dowel pin that is adapted to secure a tool for performing the second operation.

11. A method of performing at least two operations on a work piece for use with a multi-station or a single-station progressive tooling die, comprising the steps of:

moving die sections between an open position and a closed position to perform a first operation on the work piece located between the die sections; and actuating a mechanism having a tool to perform a second operation on the work piece as the die sections move between the open position and the closed position by guiding the tool toward the work piece using a first angled portion of a cam track and then guiding the tool away from the work piece using a second angled portion of the cam track.

12. The method recited in claim 11, including moving the die sections to mechanically actuate the mechanism.

13. The method recited in claim 11, including guiding a cam member of the mechanism using the cam track to selectively move the tool relative to the work piece.

14. The method recited in claim 13, including moving the cam member along the first angled portion of the cam track during movement of the die section from the closed position to the open position to move the tool farther from the work piece.

15. The method recited in claim 14, including moving the cam member along the second angled portion of the cam track during movement of the die section from the closed position to the open position to move the tool closer to the work piece.

16. The method recited in claim 14, including moving the cam member along a V-shaped portion of the cam track during movement of the die section from the open position the closed position to first extend the tool closer to the work piece and then retract the tool away from the work piece.

* * * * *